US008720338B2

(12) United States Patent
Rousseau

(10) Patent No.: US 8,720,338 B2
(45) Date of Patent: May 13, 2014

(54) PROCESS FOR CONTROLLING THE QUANTITY OF INK APPLIED TO A MATERIAL BEING PRINTED AND CORRESPONDING DEVICE

(75) Inventor: Nicolas Rousseau, Chantilly (FR)

(73) Assignee: Goss International Montataire SA, Montataire (FR)

( * ) Notice: Subject to any disclaimer, the term of this patent is extended or adjusted under 35 U.S.C. 154(b) by 854 days.

(21) Appl. No.: 11/590,261

(22) Filed: Oct. 31, 2006

(65) Prior Publication Data

US 2007/0101887 A1 May 10, 2007

(30) Foreign Application Priority Data

Nov. 3, 2005 (FR) ..... 05 11209

(51) Int. Cl.
*B41F 31/00* (2006.01)
*B41F 33/00* (2006.01)

(52) U.S. Cl.
USPC ..... 101/484; 101/350.4; 101/492

(58) Field of Classification Search
USPC ..... 101/483, 484, 492, 350.4
See application file for complete search history.

(56) References Cited

U.S. PATENT DOCUMENTS

| | | | | |
|---|---|---|---|---|
| 3,567,923 | A * | 3/1971 | Hutchison | 101/484 |
| 3,835,777 | A * | 9/1974 | Krygeris | 101/350.4 |
| 5,001,512 | A * | 3/1991 | Kubota | 355/38 |
| 6,318,829 | B1 * | 11/2001 | Suzuki | 347/11 |
| 6,450,097 | B1 * | 9/2002 | Kistler et al. | 101/483 |
| 6,481,352 | B2 * | 11/2002 | Mayer et al. | 101/484 |
| 6,985,792 | B2 * | 1/2006 | Tomelleri | 700/176 |
| 2001/0003955 | A1 * | 6/2001 | Mayer et al. | 101/183 |
| 2002/0073867 | A1 | 6/2002 | Anweiler et al. | |
| 2003/0056674 | A1 * | 3/2003 | Callahan et al. | 101/484 |
| 2003/0076520 | A1 * | 4/2003 | Haines et al. | 358/1.12 |
| 2003/0084800 | A1 * | 5/2003 | Anweiler et al. | 101/350.1 |
| 2003/0101884 | A1 * | 6/2003 | Loffler et al. | 101/350.2 |
| 2005/0134872 | A1 * | 6/2005 | Maki | 358/1.6 |
| 2005/0204945 | A1 * | 9/2005 | Sonokawa | 101/463.1 |
| 2006/0005722 | A1 * | 1/2006 | Nobukawa et al. | 101/181 |
| 2006/0081139 | A1 * | 4/2006 | Bolza-Schunemann | 101/148 |

(Continued)

FOREIGN PATENT DOCUMENTS

| | | | |
|---|---|---|---|
| DE | 100 13 876 | A1 | 10/2000 |
| JP | 6-115053 | A | 4/1994 |

(Continued)

OTHER PUBLICATIONS

Translation of Notification of Reasons for Refusal for related JP Patent Application No. 2006-300716 dispatched on Nov. 4, 2011.

*Primary Examiner* — David Banh
(74) *Attorney, Agent, or Firm* — Davidson, Davidson & Kappel, LLC

(57) ABSTRACT

A process for controlling the quantity of ink applied to a material being printed includes the stages of: driving an inking roller and a printing roller at first inking and printing speeds, changing the printing speed to a second printing speed, changing the inking speed to a second inking speed on the basis of a speed correction index, measuring a first and a second quantity of ink, calculating the difference in the quantities of ink applied, and altering the speed correction parameter on the basis of the difference in the quantity of ink printed. The process may be applied to offset presses.

7 Claims, 2 Drawing Sheets

(56) References Cited

U.S. PATENT DOCUMENTS

| | | | | |
|---|---|---|---|---|
| 2006/0102030 | A1* | 5/2006 | Hirano | 101/350.1 |
| 2006/0102038 | A1* | 5/2006 | Kruempelmann et al. | 101/484 |
| 2007/0119318 | A1* | 5/2007 | Niemiro | 101/366 |
| 2007/0201066 | A1* | 8/2007 | Ziv | 358/1.9 |
| 2008/0011171 | A1* | 1/2008 | Schneider et al. | 101/350.1 |

FOREIGN PATENT DOCUMENTS

| | | | |
|---|---|---|---|
| JP | 2000 255037 | | 9/2000 |
| JP | 2001 328235 | | 11/2001 |
| JP | 2003048309 | A | 2/2003 |
| JP | 53-2106 | | 1/2006 |
| WO | 2005060695 | A2 | 7/2005 |

* cited by examiner

PROCESS FOR CONTROLLING THE QUANTITY OF INK APPLIED TO A MATERIAL BEING PRINTED AND CORRESPONDING DEVICE

This application claims the benefit of French Application No. 05 11209 filed Nov. 3, 2005 and hereby incorporated by reference herein.

TECHNICAL FIELD

This invention relates to a process for controlling the quantity of ink applied to a material being printed by a printing unit.

It applies in particular to offset web rotary presses.

BACKGROUND

Devices for controlling the density of ink applied to the material being printed during the periods when the printing press is accelerating and decelerating are known. Such a device is described in document JP-A-2000255037 from Mitsubishi. The purpose of the device in this document is to maintain the density of the ink constant during the transitional stages when printing speeds change. The speed of the inking rollers is controlled in relation to the printing speed through conversion graphs stored in the memory of the system which compensate for any variation in the ink supply during accelerations or decelerations.

In addition to this, devices for adjusting the quantity of ink provided to the paper by the printing unit in relation to the machine speed and the rate of coverage are known.

A first device of this type is described in document US2002/0073.867 from Heidelberg AG. This document applies to machines equipped with an alternating ink source. Ink supply in relation to printing speed is controlled by varying the contact time between the pick-up roller and the inking ball and by regulating the speed of the inker. The purpose of this system is to compensate for local variations in density due to dispersion of the level of coverage over the machine width as printing speeds change.

The second device of this type is described in JP 2001 328 235 from MITSUBISHI. This document describes a system for controlling the supply of ink in relation to the density of the flat tint read from the paper. Control is applied to the speed of the inking roller and the opening of the adjustment screw. The system is not anticipatory, only corrective.

In addition to this, devices for optimising control of inking during the transitional stages of speed changes are known. Such a device is described in document DE 100 13 876. This document describes an algorithm for self-adaptive adjustment of the supply of ink to a printing machine which anticipates inking corrections through opening the adjustment screw to provide a stabilised speed during transitional regimes. The device calculates these corrections in relation to the difference between the densimetric or calorimetric values measured by a reading system and values calculated from a mathematical model.

The purpose of the device described is to reduce control errors and thus to increase the productivity of printing presses.

SUMMARY OF THE INVENTION

This invention relates to a process for controlling the quantity of ink applied to a material being printed by a printing unit equipped with an inking roller and an associated printing roller to a material being printed, including the stages:

a) causing the inking roller to rotate at a first inking speed, and simultaneously causing the printing roller to rotate at a first printing speed, b) changing the rotation speed of the printing roller to a second printing speed, c) changing the rotation speed of the inking roller to a second inking speed at the same time as or after the said change in the rotation speed of the printing roller on the basis of a speed correction index Known devices have the following disadvantages.

They do not allow the inking compensation graphs to be varied in relation to the conditions specific to each inking unit in order to minimise variations in the supply of ink under stabilised conditions during changes in printing speed.

Now density variations due to changes in speed depend on parameters which vary over time such as the temperature of the ink applied, the adherence of the ink, the viscosity of the ink, the properties of the printed substrate, mechanical adjustments to an inking unit and the level of coverage.

If these variations in the ink supply are only compensated for by opening the adjustment screws, they can give rise to a disadvantageous relationship between the opening of the adjustment screw and the speed of the inking roller. As a consequence inking densities may be very difficult for the operator to control.

An object of this invention is to overcome the disadvantages mentioned and to provide a process for controlling a printing unit through which a more regular application of ink to a material being printed can be achieved.

The present invention provides a process including the following stages:

measuring at least a first quantity of ink applied to the material being printed when the inking roller and the printing roller rotate at the first inking and printing speeds, measuring at least a second quantity of ink applied to the material being printed when the inking roller and the printing roller rotate at the second inking and printing speeds, calculating a value for the difference representing the difference in a quantity of ink applied between the first and second quantities of ink printed, and altering the speed correction parameter TI in relation to the value of the difference in the quantity of ink printed.

In accordance with particular embodiments the process according to the invention may include the following features:

the first quantity of ink and the second quantity of ink may be measured at constant inking and printing speeds, at least one of the first and second quantities of ink may be measured by a densimetric measurement, at least one of the first and second quantities of ink may be measured by a colorimetric measurement, the value of the difference may be calculated using the following formula:

$$S_i(V_{i1}, V_2) = \frac{D(V_{i1})}{D(V_2)}$$

where

Si(Vi1,V2) is the value of the difference for a change in the printing speed from Vi1 to V2, i is an index characterizing a given speed change Vi1 is the first printing speed V2 is the second printing speed D(Vi1) is the quantity of ink applied at printing speed Vi1, and D(V2) is the quantity of ink applied at printing speed V2, at least a first graph of values of the inking roller correction index may be calculated, in which at least two points comply with the formula $$TI(V) = \frac{VIR(V,\ IR\ \text{set point})}{VIR\ \max \cdot IR\ \text{set point}}, \qquad \text{(Formula I)}$$

in which

TI(V)=value of the correction index for printing speed V,

VIR(V, IR set point)=actual speed of the inking roller for a given printing speed V and a given nominal IR set point, VIRMAX=maximum speed of the inking roller, IR set point=the nominal set point specified by the operator, the or each of the graphs of values of the correction index may be a graph defined by a whole number of points corresponding to Formula I between which the graph is interpolated, in particular interpolated linearly, the process may be characterised by a stage of optimising at least one graph of correction index values using the following equation:

$$\frac{\sum_{i=1}^{n}\left(S_i(V_{i1},\ V_2)\cdot TI_{old}(V_2)\cdot\frac{TI_{new}(V_{i1})}{TI_{old}(V_{i1})}\right)}{n} = TI_{new}(V_2)$$

where n=the number of speed changes considered, i=an index characterising a given speed change, Si=the ratio of the quantity of ink applied to the material being printed before and after speed change i respectively, Vi1=the printing speed before speed change i, V2=the printing speed after speed change i, TInew(Vi1)=new value of the correction index characterising control of the inking speed based on the printing speed Vi1 for an inking roller IR set point of 100%, TInew(V2)=new value of the correction index characterising control of the inking speed in relation to the printing speed V2 for an inking roller IR set point of 100%, TIold(Vi1)=previous value of the correction index used characterising the graph of correction index values for the inking roller in relation to printing speed Vi1 at the time of speed change i, for an inking roller set point adjusted to 100%, TIold(V2)=previous value of the correction index used, the at least one graph of inking roller speed correction index values based on a printing speed V2 at the time of speed change i, for an inking roller set point set to 100%, at least a second graph of values of the inking roller correction index may be calculated as described above, the graphs for the values of the correction index are calculated using two different types of consumables, in particular two different types of ink or two different types of paper, and the graphs for the values of the correction index and a parameter representing the type of consumable are stored in a memory, the control process may be characterised by the following stages:

termination of the current command, altering the correction index on the basis of the value of the difference calculated for the subsequent printing commands, and the process of controlling the thickness of the ink from at least two printing units is characterised by using a process as described above for each of the printing units.

In accordance with another aspect of the invention, the present invention provides a device for controlling the thickness of the ink applied by a printing unit provided with an inking roller and an associated printing roller on a material requiring printing of the type including:

means for driving the printing roller in rotation at a printing speed, means for driving the inking roller in rotation at an inking speed, control means for the rotation drive means designed to control the drive speeds of the inking and printing rollers, measurement means designed to detect the quantity of ink deposited on the material being printed, a memory designed to store a speed correction index, characterised in that the control means are designed to control the inking speed on the basis of the speed correction index, the measurement means are designed to measure a first quantity of ink printed onto the material when the inking roller and the printing roller rotate at the first inking and printing speeds, and to measure a second quantity of ink printed onto the material being printed when the inking roller and the printing roller rotate at the second inking and printing speeds, the calculation means are designed to calculate a value for the difference representing the difference in the quantity of ink printed between the first and second quantities of ink printed, and to alteration of the speed correction parameter on the basis of the value of the difference in the quantity of ink printed.

In accordance with a particular embodiment the device according to the invention may include the following feature:

the adjustment device may be characterised in that it is also designed to implement one of the processes as described above.

BRIEF DESCRIPTION OF THE FIGURES

Other advantages and characteristics of the present invention will become clear from the following detailed description which is given with reference to the appended drawings which are provided purely by way of non-limiting example and in which.

DESCRIPTION OF PREFERRED EMBODIMENTS

Figure 1:
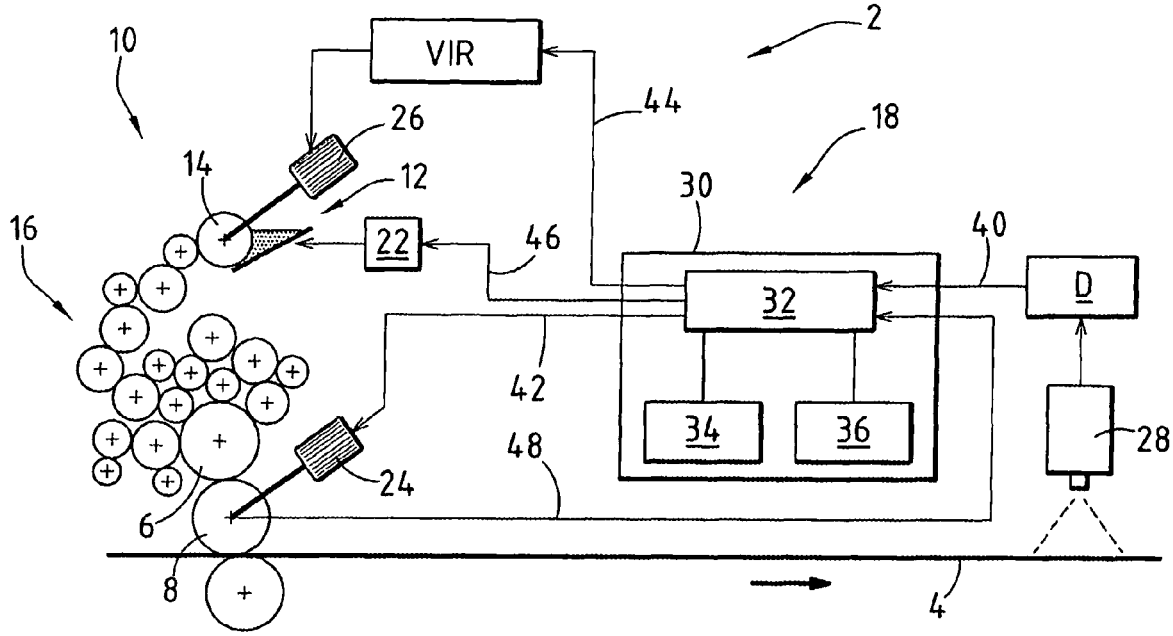
FIG. 1 is a diagrammatical view of a printing unit according to the invention.

FIG. 1 illustrates a printing unit according to the invention, designated by the general reference 2.

This printing unit 2 is installed in a web offset printing press comprising a plurality of such printing units. Each printing unit 2 is designed to print on a material being printed, in the case in point a web of paper 4.

In this respect printing unit 2 comprises a plate roller 6 and a blanket roller 8 forming a printing roller in contact with web of paper 4.

Printing unit 2 further comprises an inking device 10, also known as an inking unit, provided with an ink reservoir 12, an inking roller 14 and a plurality of distribution rollers 16.

Printing unit 2 is also provided with a device 18 which controls the quantity of ink applied to web of paper 4.

Inking roller 14 is in continuous contact with the ink present in ink reservoir 12 and is designed to transfer ink to distribution rollers 16. Distribution rollers 16 are designed to apply ink onto plate roller 6. Inking roller 14 is in continuous contact with one of distribution rollers 16. In another embodiment the contact may be alternating.

Control device 18 comprises a plurality of adjustment screws 22 which are designed to control the thickness of the ink film passed from ink reservoir 12 to inking roller 14.

In addition to this, adjustment device 18 comprises a first motor 24 designed to drive blanket roller 8 in rotation, and a second motor 26, designed to drive inking roller 14 in rotation.

Control device 18 is also provided with detection means designed to detect the quantity of ink applied to web of paper 4. These detection means are in the case in point a camera 28 which can detect the density D of the ink applied to web 4.

Control device 18 comprises a microcontroller 30 with a processor 32, a buffer memory 34 and a memory 36.

Camera 28 is connected to microcontroller 30 through a first sensor line 40. Thus microcontroller 30 is designed to receive a value representing the quantity of ink deposited on web 4, in the case in point a value representing the density D. As a variant camera 28 detects a calorimetric value.

Furthermore, processor 32 is connected to first motor 24 through a first control line 42 and to second motor 26 through a second control line 44. Thus microcontroller 30 is designed to control both the printing speed, which is the speed of rotation of blanket roller 8, and the inking speed, which is the speed of rotation of inking roller 14. A third control line 46 connects microcontroller 30 to adjustment screw 22 with a view to controlling the position of that screw 22.

A second sensor line 48 connects blanket roller 8 to microcontroller 30 to detect the rotation speed of that roller 8.

Printing unit 2 operates in the following way.

Let us assume that printing unit 2 operates at a first printing speed V1, which is 30% of the maximum printing speed Vmax. The first corresponding inking speed VIR1 is then calculated as follows:

$$VIR1(V1, IR\ \text{set point}) = VIR\max \times IR\ \text{set point} \times TI(V1),$$

where

VIRmax is the maximum speed of the inking roller,

IR set point is a nominal set point value defined by the operator and is greater than 0% and less than or equal to 100%, and TI(V1) is the value of a correction index for printing speed 1. This value lies between 0% and 100%.

Figure 2:
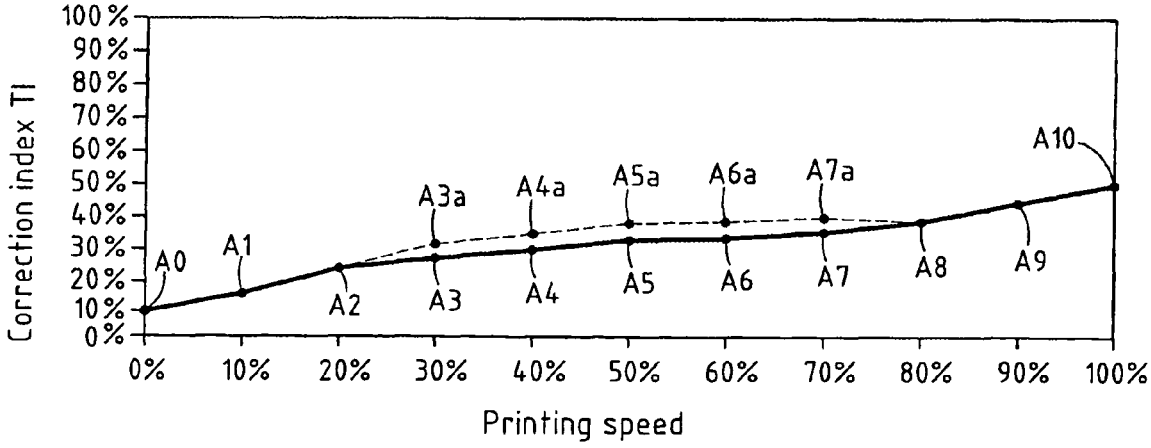
FIG. 2 shows a graph of inking speed correction values.

This correction index TI(V) is stored in memory 36, and is represented by the dashed line in the graph in FIG. 2. This graph comprises a correction index for each printing speed V between 0% and 100% of the maximum printing speed Vmax. In the case in point the line in the graph is defined by reference points A0 to A10 which define the value of index TI (V) at 10% intervals of the printing speed starting from 0%. Between reference points A0 and A10 the line is interpolated linearly. In the example given the value of the correction index TI(V1=30%) is approximately 25%.

When the printing speed is changed to a second printing speed V2, which is for example 50% of the maximum printing speed Vmax, the inking speed is as a consequence changed through a correction parameter TI(V2=50%) which has a value of 30%.

However the actual supply of ink to paper 4 depends on parameters which vary over time such as the temperature of the ink applied, the adherence of the ink, the viscosity of the ink, the properties of the printed substrate, the mechanical adjustments of the inking unit and the coverage level. These parameters change with time and as a consequence the values TI(V) stored in memory 36 ultimately no longer correspond to the aforesaid parameters. As a consequence the supply of ink before and after the change in printing speed from V1 to V2 is not constant.

Figure 3:
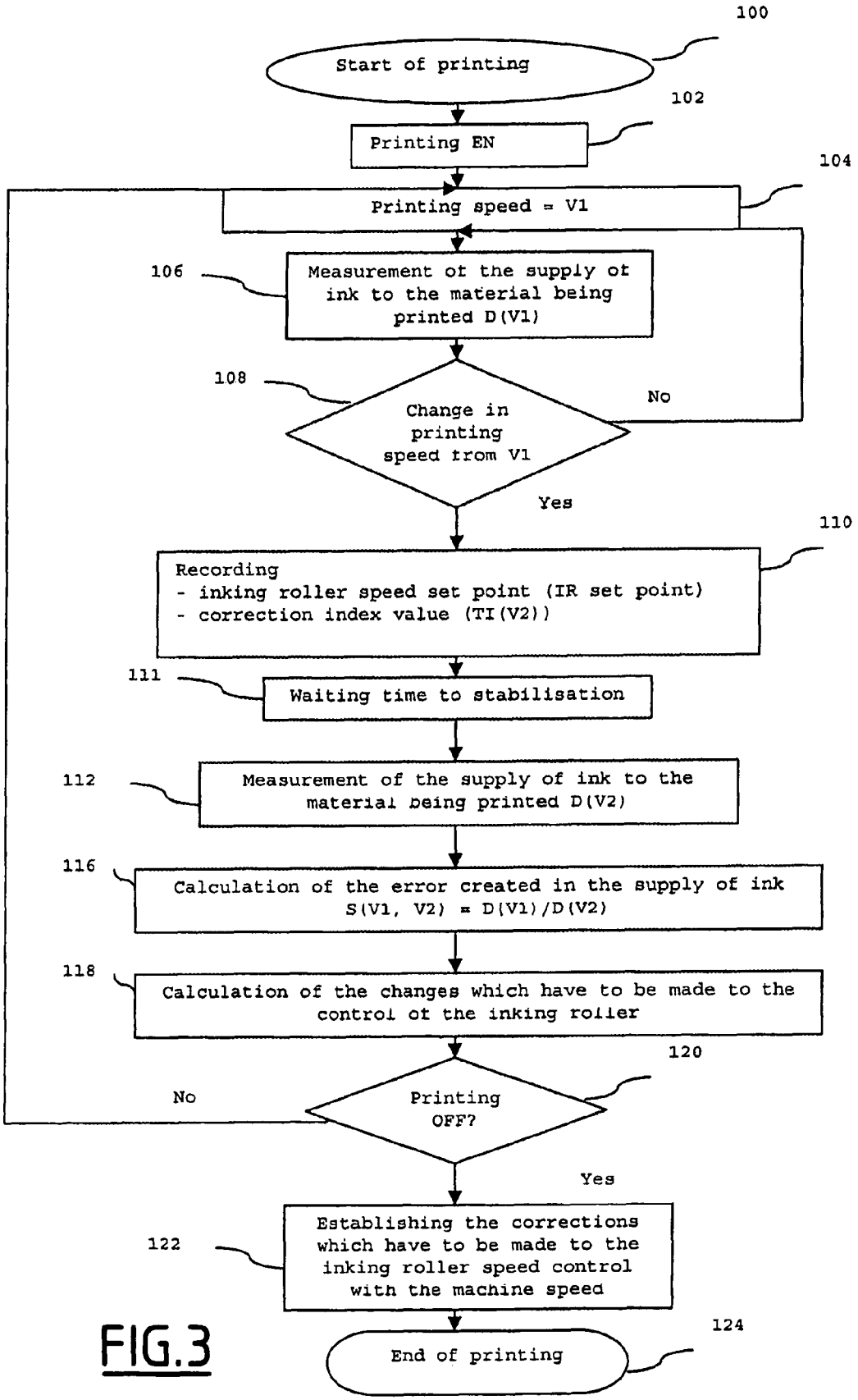
FIG. 3 shows a flowchart of a process according to the invention.

Thus, in accordance with the invention, the values of index TI (V) must be changed. The manner of changing the values of the index TI (V) in this printing unit 2 will be explained below with reference to FIG. 3.

Printing of an order which comprises printers printing a particular number of copies begins at stage 100.

At the next stage 102 printing proper is started, that is printing unit 2 begins to apply ink onto web of paper 4.

In stage 104 blanket roller 8 is driven by first motor 24 at a first constant printing speed V1.

At stage 106, the supply of ink to the web of paper 4 is measured. In other words camera 28 detects the density D(V1) of the ink actually applied to web 4 and generates a corresponding signal which is passed to microcontroller 30 via sensor line 40.

At stage 108 a check is made to see whether the printing speed has changed from speed V1 to a speed V2. This check is performed by microcontroller 30 which receives a signal corresponding to the printing speed via second sensor line 48.

If the printing speed has not changed, that is it is still equal to speed V1, a return is made to ink measuring stage 106. Alternatively it is possible to return directly to stage 108 in order to recover the last density measurements made on the paper before the change of speed.

When the printing speed has changed to a second constant speed V2 stage 110 is implemented. In this stage 110 a set point for the speed of inking roller 14 (IR set point) is recorded by processor 32. The IR set point is defined by the operator when printing starts. The IR set point remains constant when the printing speed changes, unless it is altered by the operator. This IR set point represents the set speed at which inking roller 14 is driven when blanket roller 8 is driven at its maximum speed 100%.

In addition to this, the value of correction index TI (V2) is drawn from memory 36. This value is the ordinate of the solid line in FIG. 2, corresponding to the abscissa V2. For example, in the case where the second printing speed V2 is 50% of the maximum speed of blanket roller 8, the value of TI (V2) is approximately 30%.

Inking roller 14 is then driven at a constant speed VIR2=VIRmax×IR set point×TI (V2).

Stage 111 comprises a period of waiting for the previously defined ink supply to stabilise.

Then during stage 112 the quantity of ink applied to material 4 being printed is measured. These measurements are made in the same way as the measurement in stage 106.

When the ink supply has stabilised, the error created in the ink supply is calculated in stage 116. In other words a value representing the difference between the quantity of ink applied at printing speeds V1 and V2 is calculated.

The error is expressed by a difference value S which is calculated using the following formula:

$$S_i(V_{i1}, V_2) = \frac{D(V_{i1})}{D(V_2)}$$

where

Si(Vi1,V2) is the value of the difference for the change in printing speed from Vi1 and V2, i is an index characterizing a given speed change Vi1 is the first printing speed V2 is the second printing speed D(Vi1) is the quantity of ink applied at printing speed Vi1, and D(V2) is the quantity of ink applied at printing speed V2.

In other words, in order to maintain a constant supply of ink to web 4 the inking speed of inking roller 14 has to be multiplied by a correction factor equal to S. This calculation is based on the fact that the supply of ink is directly proportional to the inking speed, to a first approximation.

Then, during stage 118 the change which has to be made to the speed of inking roller 14 is calculated.

These calculations are carried out as follows. The graph for the correction index TI (V) for inking roller 14 shown in FIG. 2 satisfies the formula $$TI(V) = \frac{VIR(V, IR \text{ set point})}{VIR\max \times IR \text{ set point}}, \quad \text{(Formula I)}$$

where

TI(V)=correction index for printing speed V,

VIR(V, IR set point)=actual speed of inking roller 14 for a given printing speed V and a given nominal IR set point, VIRMAX=maximum speed of the inking roller, IR set point=nominal set point defined by the operator.

An amended value of the correction index TI amended (V2) is calculated using the formula $$TI_{amended}(V_2) = TI(V_2)(S(V_1; V_2)$$

$$= \frac{VIR(V, IR \text{ set point})}{VIR \max \times IR \text{ set point}} \times \frac{D(V_1)}{D(V_2)}$$

This amended value of the correction index is stored in buffer memory 34 and is not used to adjust the inking speed for the current command.

In the example given, the amended value of the correction index Tlamended (V2=50%) is slightly higher than the value TI (V2=50%).

This corrected value is represented as point A5*a* in FIG. 2.

In stage 120 a check is made to see whether the command has been completed.

If this is not the case, the process is continued in stage 104. In this case when there is a further change in the printing speed the value of the correction index is altered as appropriate in the manner described above. At the end of the command buffer memory 34 thus includes the changed values of the correction index. These values are for example represented by the dashed line in the graph in FIG. 2.

The different speed changes give rise to a graph defined by the points A0 to A2, A8 to A10 and the corrected points A3*a* to A7*a*.

If on the other hand the command has been completed, the calculated altered values of the correction index are transferred from buffer memory 34 to memory 36 in order to be used for the next printing command.

Printing stops at stage 124. The process according to the invention provides for automatic learning or automatic adjustment of the correction index values, requiring no action by the operator. In addition to this, the printed ink density is held constant when changes occur in the printing speed, despite the variation in parameters such as the ink density over time.

In addition to this, few modifications to existing presses are required for retrofitting adjustment device 18.

The stages of calculation in the process are implemented by microcontroller 30.

The process according to the invention may be improved in the following way by optimising the graphs of the inking roller speed correction index on the basis of the derivative of the supply of ink observed on the substrate as speeds change.

In accordance with the improvement, a stage of optimising the correction index graph is implemented in which the TI (V) values are altered according to the following equation:

$$\frac{\sum_{i=1}^{n}\left(S_i(V_{i1}, V_2) \cdot TI_{old}(V_2) \cdot \frac{TI_{new}(V_{i1})}{TI_{old}(V_{i1})}\right)}{n} = TI_{new}(V_2)$$

where n=the number of speed changes considered, i=an index characterising a given speed change, Si=ratio of the quantity of ink applied to the material being printed before and after speed change i respectively (=difference value), Vi1=printing speed before speed change i, V2=printing speed after speed change i, TInew(Vi1): new value of the correction index characterising control of the inking speed based on the printing speed Vi1 for an inking roller IR set point of 100%, TInew(V2): new value of the correction index characterising control of the inking roller speed on the basis of the machine speed V2 for an inking roller set point of 100%, TIi(Vx): previous value of the correction index used, characterising the inking roller control graph on the basis of machine speed Vi1 during speed change i, for an inking roller set point set to 100%, TIold(V2): previous value of the correction index used, the at least one graph of inking roller speed correction index values based on a printing speed V2 at the time of speed change i, for an inking roller set point set to 100%.

This stage is therefore characterised by taking the difference values for n previous speed changes between a first printing speed V1 and a second give printing speed V2 into account.

The process according to the invention is preferably applied to each inking unit of a printing press having at least two printing units.

This stage makes it possible to minimise the drift occurring in the course of speed changes i considered.

The following improvements may be made to the process according to the invention:

Microcontroller 30 may be provided with an additional memory in which the values of previous TI(V) parameters are stored. Changed values of TI(V) may be calculated with regard to these historical parameters.

In accordance with another variant of the process, a maintenance decision stage may be added. During this stage it is decided whether maintenance work on the printing unit is required.

If speeds V1 and V2 are not the same as the speeds defined by points A1 to A10, TI(V) is calculated by interpolation.

According to another feature of the process, at least a second graph of inking roller correction index values is calculated using a process as defined above, the two graphs for values of the correction index being calculated when two different types of consumables are used, in particular two different types of ink or two different types of paper, and the graphs of the correction index values and a parameter representing the type of consumable are stored in a memory.

What is claimed is:

1. A method for controlling the ink quantity applied to a material being printed by a printing unit, the printing unit including an inking roller and a corresponding printing roller, comprising the steps of:

a) driving the inking roller in rotation at a first inking speed (VIR1), and simultaneously driving the printing roller in rotation at a first printing speed (V1);

b) changing the rotation speed of the printing roller to a second printing speed (V2);

c) changing the rotation speed of the inking roller to a second inking speed (VIR2) during or after the change in the rotation speed of the printing roller based on a speed correction index ($TI_{old}$(V));

d) measuring at least a first ink quantity (D(V1)) applied to the material being printed when the inking roller and the printing roller rotate at the first inking speed (VIR1) and printing speed (V1);

e) measuring at least a second ink quantity (D(V2)) applied to the material being printed when the inking roller and the printing roller rotate at the second inking speed (VIR2) and second printing speed (V2);

f) calculating a value for the difference (S) representing the difference in the ink quantity applied between the first and second ink quantities printed;

g) generating a new speed correction index $TI_{new}$ (V) which is an altered version of the speed correction index $TI_{old}$ (V) based on the value of the difference (S) in the ink quantity printed;

h) maintaining a desired ink quantity by using the new speed correction index $TI_{new}$ (V) to compensate for variances over time in temperature of the ink, adherence of the ink, viscosity of the ink, properties of the printing substrate or mechanical adjustments to the inking unit;

i) driving the inking roller in rotation at the first inking speed (VIR1), and simultaneously driving the printing roller in rotation at the first printing speed (V1);

j) changing the rotation speed of the printing roller to the second printing speed (V2); and k) changing the rotation speed of the inking roller to the second inking speed (VIR2) during or after the change in the rotation speed of the printing roller in step j) based on the new speed correction index $TI_{new}$ (V).

2. The control process as recited in claim 1 wherein the first ink quantity (D(V1)) and the second ink quantity (D(V2)) are measured at constant inking and printing speeds.

3. The control process as recited in claim 1 wherein at least one of the measurements of the first (D(V1)) and second (D(V2)) ink quantities is a densimetric measurement.

4. The control process as recited in claim 1 wherein at least one of the measurements of the first (D(V1)) and second (D(V2)) ink quantities is a colorimetric measurement.

5. The control process as recited in claim 1 further comprising the steps of:

terminating a current print job; and altering the correction index after the current print job is terminated and prior to a start of a subsequent print job based on the value of the calculated difference for subsequent print jobs.

6. A process for adjusting a thickness of ink from at least two printing units including implementing the control process as recited in claim 1 for each of the at least two printing units.

7. The control process as recited in claim 1 wherein the step of measuring the first ink quantity or the step of measuring the second ink quantity includes a camera detecting the first or second ink quantity on the material, respectively.

* * * * *